US006932285B1

(12) United States Patent
Zeng

(10) Patent No.: US 6,932,285 B1
(45) Date of Patent: Aug. 23, 2005

(54) ORIFICE BODY WITH MIXING CHAMBER FOR ABRASIVE WATER JET CUTTING

(75) Inventor: Jiyue Zeng, Bellevue, WA (US)

(73) Assignee: OMAX Corporation, Kent, WA (US)

( * ) Notice: Subject to any disclaimer, the term of this patent is extended or adjusted under 35 U.S.C. 154(b) by 549 days.

(21) Appl. No.: 09/595,325

(22) Filed: Jun. 16, 2000

(51) Int. Cl.[7] ..... B05B 1/00

(52) U.S. Cl. ..... 239/589; 239/288; 239/433; 239/591; 239/596; 239/600; 175/340; 451/99; 451/102

(58) Field of Search ..... 239/433, 434, 239/589, 591, 594, 596, 600, 601, DIG. 4, 239/288; 175/340, 393; 83/53, 177; 451/75, 451/99–102

(56) References Cited

U.S. PATENT DOCUMENTS

| | | | | |
|---|---|---|---|---|
| 817,058 | A | 4/1906 | Greenfield | |
| 2,009,932 | A | 7/1935 | Klotzman | |
| 2,376,287 | A | 5/1945 | Sorrentino | |
| 3,088,854 | A | 5/1963 | Spies | |
| 3,750,961 | A * | 8/1973 | Franz | 239/600 |
| 3,756,106 | A | 9/1973 | Chadwick et al. | |
| 3,997,111 | A | 12/1976 | Thomas et al. | |
| 4,391,339 | A * | 7/1983 | Johnson, Jr. et al. | 239/589 X |
| 4,392,534 | A * | 7/1983 | Miida | 175/340 |
| 4,594,924 | A | 6/1986 | Windisch | |
| 4,817,874 | A | 4/1989 | Jarzebowicz | |
| 4,848,761 | A | 7/1989 | Rice | |
| 4,852,800 | A | 8/1989 | Murdock | |
| 5,018,670 | A | 5/1991 | Chalmers | |
| 5,092,085 | A * | 3/1992 | Hashish et al. | 451/102 |
| 5,139,202 | A | 8/1992 | Munoz et al. | |
| 5,226,597 | A | 7/1993 | Ursic | |
| 5,320,289 | A | 6/1994 | Hashish et al. | |
| 5,335,459 | A | 8/1994 | Dale | |
| 5,643,058 | A | 7/1997 | Erichsen et al. | |
| 5,730,358 | A | 3/1998 | Raghavan et al. | |

OTHER PUBLICATIONS

Tube Holder Collett drawing; John Olsen; Aug. 15, 1994.
Abrasive Jet Nozzel Assembly drawing; John Olsen; Jun. 18, 1994.
Ingle L.Evel Bom for Part 300279-A; Abrasive Jet Nozzel Assembly with a Dia Sapphire parts list; Sep. 14, 1995.

* cited by examiner

*Primary Examiner*—Steven J. Ganey
(74) *Attorney, Agent, or Firm*—Graybeal Jackson Haley LLP

(57) ABSTRACT

An improved orifice assembly for use with an ultra high pressure fluid jet cutting apparatus is disclosed. The improved orifice assembly generally includes an orifice body defining a central bore, a high pressure inlet cavity located at an upstream portion of the body, a mixing cavity located at a downstream portion of the body, and an abrasive material inlet bore that is in direct communication with the mixing cavity. The inlet or high pressure cavity preferably has a cylindrical cross section at the side wall portion and a generally flat bottom wall, with a constant radius transition portion between the side and bottom walls. A jeweled orifice is preferably located at the bottom wall and forms a portion thereof. A chamfer at the downstream portion of the mixing chamber permits appropriate coaxial alignment of a mixing tube with the jeweled orifice so as to preserve proper fluid flow characteristics. In addition, the incorporation of a soft seal between the mating surfaces of the inlet body and the orifice assembly permit easy user removal of these components from a cutting jet system.

4 Claims, 3 Drawing Sheets

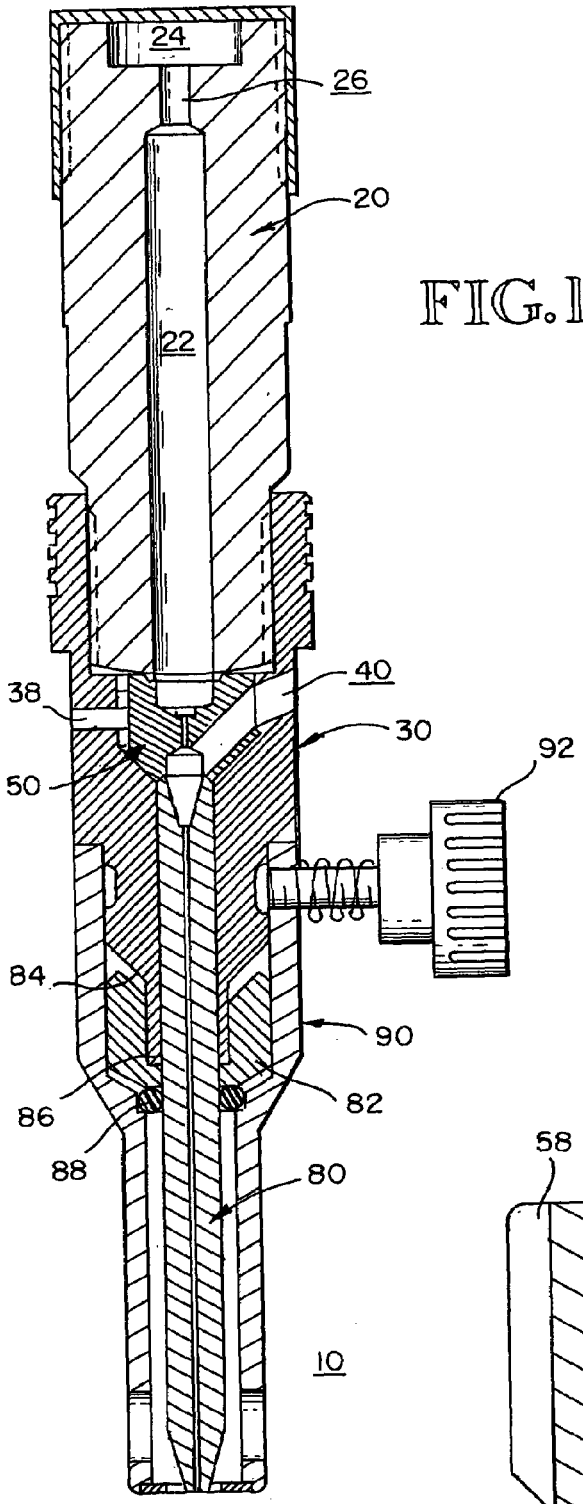
FIG. 1
FIG. 2
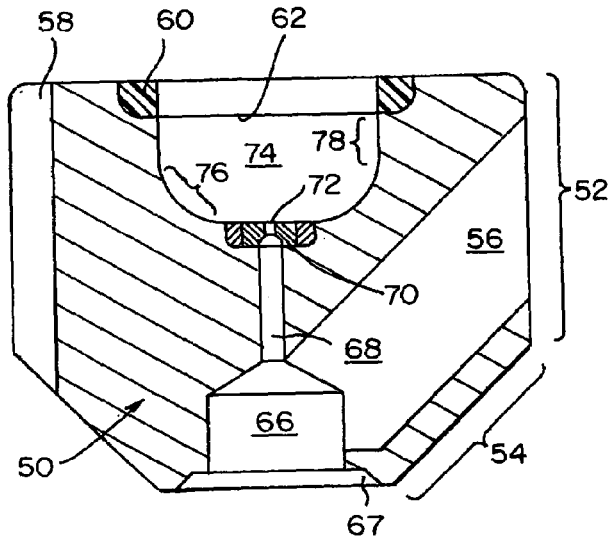

ORIFICE BODY WITH MIXING CHAMBER FOR ABRASIVE WATER JET CUTTING

TECHNICAL FIELD

The present invention relates to the field of ultra-high pressure fluid jet cutting apparatus and more particularly to improvements concerning nozzles therefor.

BACKGROUND OF THE INVENTION

The field of ultra-high pressure fluid jet cutting technology has seen many advances from its infancy in the early to mid 1970's until the present. Fluid pump technology has advanced to the point that pressures in excess of 60,000 psi are routinely used in commercial settings; material science advances have increased the longevity of the wear components. This, of course, is not to say that all that can be invented has been invented.

The basic components of an ultra-high pressure fluid jet cutting system include a pump for providing a source of ultra-high pressure fluid and a nozzle assembly. The nozzle assembly generally comprises an inlet body, a precisely formed orifice for creating a jet of ultra-high pressure fluid, a mixing chamber for receiving and integrating abrasive material to enhance the cutting properties of the jet, and a mixing tube to further integrate the abrasive material and form the desired column or jet of abrasive suspended fluid. While many components of the overall system are subject to wear, both the precisely formed orifice and components downstream therefrom are particularly subject to wear due to the presence of abrasive material suspended in an ultra-high pressure fluid.

Another factor concerning high pressure fluid nozzles relates to the alignment of the orifice with the mixing tube. Misalignment of the orifice with the remaining downstream components can seriously affect both the performance of the nozzle as well as the longevity of its components.

In view of the foregoing facts, it is desirable to create a nozzle assembly that provides precise alignment between the orifice and the distal or downstream portion of the mixing tube so as to minimize wear due to misalignment, and to create a nozzle assembly that provides for easy replacement of wear parts. Moreover, it is desirable to form as precise a jet as possible, and therefore any factors that may interfere with such operations, such as turbulence prior to the pressurized fluid passing through the orifice, are to be avoided.

SUMMARY OF THE INVENTION

The present invention concerns improvements to the design and operation of nozzle assemblies for use with ultra-high pressure fluid jet cutting apparatus. In particular, the improvements concern the orifice assembly, also known in the art as the jewel holder. It is an object of the invention to provide an orifice assembly having an improved inlet chamber geometry at the interface between an inlet body and the orifice that defines the diameter of jetting water so as to optimize the column of high pressure water emanating from the orifice. It also is an object of the invention to provide for a soft seal at the interface between an inlet body and the orifice assembly so that a user may remove and install the orifice assembly by hand. It is a further object of the invention to provide for a tapered interface between the orifice assembly and a nozzle so that the axial alignment between the jewel orifice and the nozzle bore remains in close tolerance.

The orifice assembly of the present invention comprises an orifice body having an upstream portion at a first end and a downstream portion at a second end. A central bore extends from the first end to the second end to establish a fluid conduit for the high pressure fluid. The downstream portion of the orifice body defines a mixing cavity and preferably a generally lateral bore in communication therewith whereby abrasive material can be introduced into the fluid jet. The upstream portion of the orifice body defines a high pressure cavity having a generally cylindrical side wall and a bottom wall generally normal to the axis of the central bore wherein a transition portion between the side wall and the bottom wall has a generally quarter circle curvilinear sectional profile to provide a constant radius transition between the side wall and the bottom wall. At a center portion of the bottom wall is formed a precise orifice that creates the desired high pressure fluid jet. Preferably, a mineral substance with a precision drilled hole is used to define the orifice.

BRIEF DESCRIPTION OF THE DRAWINGS

FIG. 1 is a cross-sectional elevation view of a high-pressure fluid jet nozzle assembly;

FIG. 2 is a cross-sectional elevation view of an orifice assembly for the nozzle assembly of FIG. 1;

DETAILED DESCRIPTION OF THE INVENTION

Figure 3:
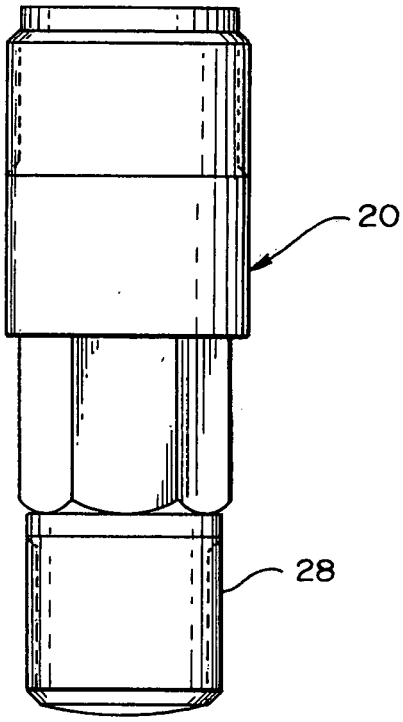
FIG. 3 is an elevation view of an inlet body for the nozzle assembly of FIG. 1.

Turning now to the several figures wherein like numbers indicate like parts, and more particularly to FIG. 1, nozzle assembly 10 is shown in cross-section. Nozzle assembly 10 has five major components, namely inlet body 20, nozzle body 30, orifice assembly or jewel holder 50, mixing tube 80, and nozzle guard 90. More detailed views of each of these complements can be found in the several sheets of drawings. Unless otherwise noted, all components except for the mixing tube are formed from high tensile strength steel so as to withstand hydrostatic pressures and related hydrodynamic shock loads during operation of nozzle assembly 10.

Figure 4:
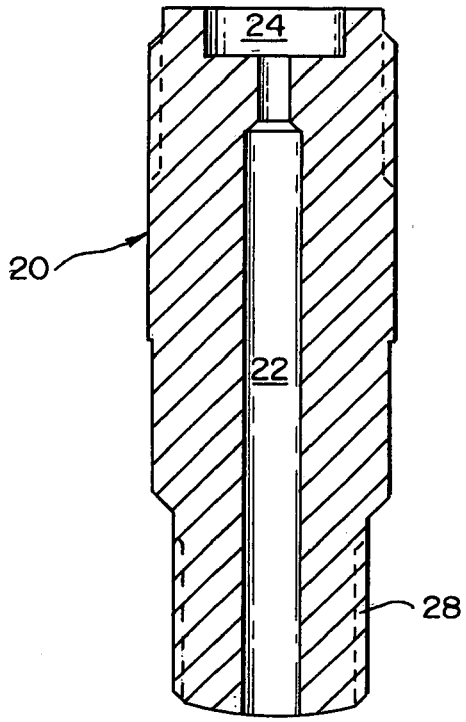
FIG. 4 is a cross-sectional elevation view of the inlet body of FIG. 3.

Turning first to inlet body 20, a detailed view can be found in FIGS. 3 and 4. As shown therein, inlet body 20 defines central bore 22, recessed seat 24, and reduced diameter portion 26, which are all coaxial with each other. Present on the outer portion of inlet body 20 is threaded portion 28 to engage complimentary threads on threaded portion 44 of nozzle body 30.

Figure 5:
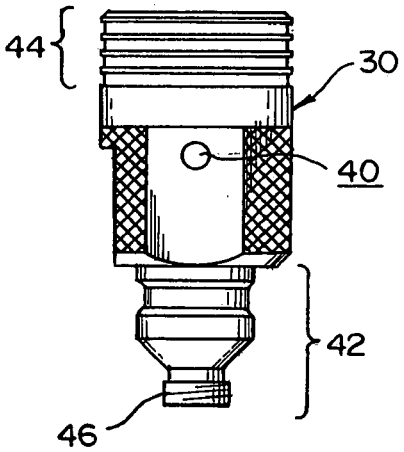
FIG. 5 is an elevation view of a nozzle body for the nozzle assembly of FIG. 1.
Figure 6:
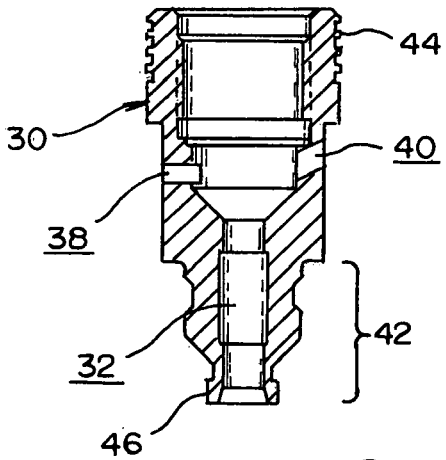
FIG. 6 is a cross-sectional elevation view of the nozzle body of FIG. 5.

FIGS. 5 and 6 show nozzle body 30 which defines central bore 32, recessed seat 34, tapered seat 36, lateral bore 38, and inclined bore 40. The exterior portions of nozzle body 30 define nipple portion 42, threaded portion 44, and threaded portion 46. As described above, threaded portion 44 engages threaded portion 28 of inlet body 20. A significant purpose of nozzle body 30 is to house orifice assembly 50.

As best shown in cross-section in FIG. 2, soft seal 60 is disposed within seal recess 62 and facilitates the mating of inlet body 20 with orifice assembly 50. Orifice assembly 50 receives high-pressure fluid from inlet body 20, and permits the introduction of abrasive material via inclined bore 56, where after it is introduced into the precise jet of high-pressure fluid in mixing cavity 66. Orifice assembly 50 is rotationally retained within inlet body 30 by pin 48, best shown in FIG. 1, engaging with slot 58. In this manner, alignment between inclined bore 56 and inclined bore 40 of nozzle body 30 is maintained. Cylindrical portion 52 and taper portion 54 are sized to fit within complementary structure present in nozzle body 30.

High-pressure cavity 74 is defined by the upstream portion of orifice assembly 50. High-pressure cavity 74 is particularly defined by cylindrical wall portion 78, transition portion 76, and a bottom wall primarily defined by jewel 70. Cylindrical wall portion 78 defines a cylinder that is coaxial about central bore 68. Conversely, the plane defined by jewel 70 which forms the bottom wall of high-pressure cavity 74 is normal to the axis of central bore 68. Jewel recess 64 is formed within orifice assembly 50 at the bottom of high pressure cavity 74 and is configured to receive and hold jewel 70 in the described position. Thus, transition portion 76 provides a curvilinear transition between wall 78 and the bottom wall defined by jewel 70. In this preferred embodiment, transition portion 76 has a constant radius between wall 78 and the bottom wall defined by jewel 70, and approximates a quarter circle in section.

Jewel 70 is preferably constructed from a synthetic mineral such as ruby or sapphire, chosen for its extreme durability when subject to high wear environments. To form the desired precise jet of high-pressure fluid, bore or orifice 72 is formed therein. Thus, high-pressure fluid present in high-pressure cavity 74 is permitted to escape via orifice 72 into central bore 68 and subsequently mixing cavity 66. The high speed of fluid introduced into mixing cavity 66 causes a below ambient pressure environment to exist in mixing cavity 66. Consequently, the suction effect causes any abrasive material located upstream from mixing cavity 66 to be drawn toward mixing cavity 66. At this point, abrasive material begins to integrate with the high pressure fluid jet created by orifice 72. A tapered seat 67 is formed in the bottom or downstream portion of orifice assembly 50. As will be shown later, the seat facilitates the appropriate alignment of a mixing tube with the orifice assembly since the mixing tube has a complementary taper.

As is best shown in FIG. 1, mixing tube 80 is connected to orifice assembly 50 by way of nozzle body 30. Collar nut 82, located on tube 80, has internal threads 84 that engage with the threads on threaded portion 46. Ferrule or stop 86 is preferably compressively attached to tube 80 to provide a suitable surface against which the collar nut 82 can seat when engaging threaded portion 46 of nozzle body 30. O-ring 88 is also disposed about tube 80 to provide protection against the abrasive grit from wearing out the nozzle components.

Figure 7:
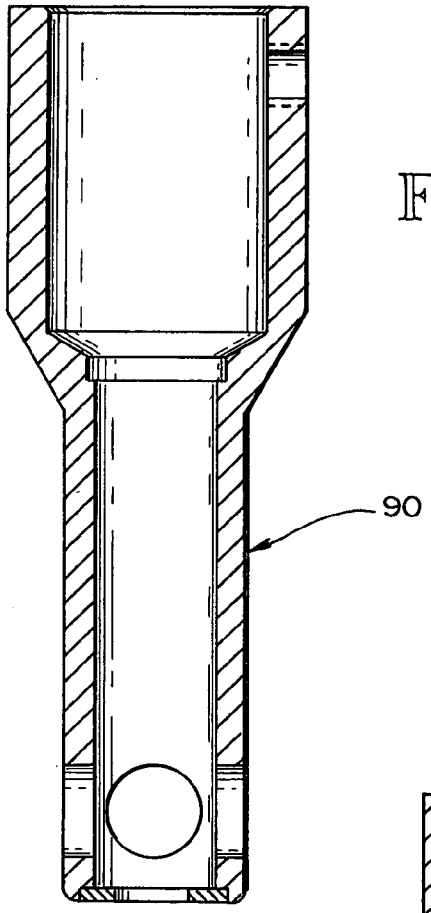
FIG. 7 is a cross-sectional elevation view of a nozzle guard for the nozzle assembly of FIG. 1.
Figure 8:
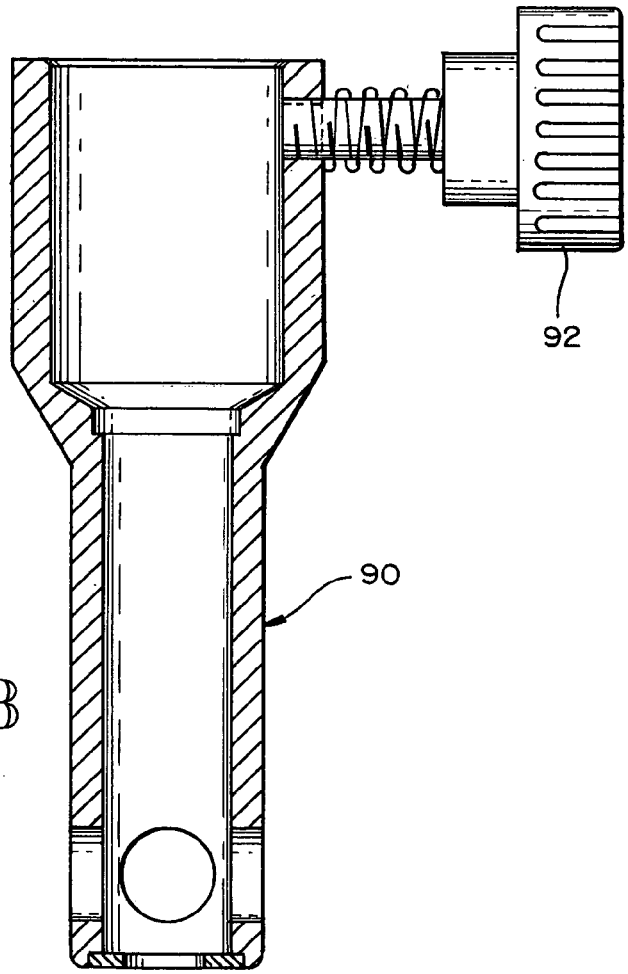
FIG. 8 is a cross-sectional elevation view of FIG. 7 also showing the position of a set screw.

FIGS. 7 and 8 best show the nature of nozzle guard 90. To facilitate the rapid engagement and disengagement of nozzle guard 90 from nozzle body 30, set screw 92 is preferably coupled with nozzle body 90 as best shown in FIG. 8. By screwing in set screw 92 when nozzle guard 90 is positioned with nozzle body 30, set screw 92 engages nipple portion 42 as best shown in FIG. 1.

What is claimed is:

1. For use in abrasive water jet cutting systems, an orifice body with a mixing cavity, comprising:

a. a metal body having an outer cylindrical surface and a central bore, parallel to the cylindrical surface, with an upstream direction and a downstream direction;

b. a jewel having an orifice mounted in the bore in the metal body, a portion of the central bore downstream of the jewel forming a mixing cavity; and c. an inclined bore for abrasive material passing from the outer cylindrical surface to the central bore at an incline and joining the central bore downstream of the jewel at an angle such that abrasive material is redirected by substantially less than 90 degrees as it passes from the inclined bore to the central bore that forms the mixing cavity, d. a rotational alignment slot in the cylindrical surface, parallel to the cylindrical surface, opposite the bore for abrasive material, extending from an upstream end of the cylindrical surface to a downstream end of the cylindrical surface.

2. For use in abrasive water jet cutting systems, an orifice body with a mixing cavity, comprising:

a. a metal body having an outer cylindrical surface, with an upstream direction and a downstream direction;

b. a central bore, parallel to the cylindrical surface;

c. a jewel having an orifice mounted in the bore in the metal body, a portion of the central bore downstream of the jewel forming a mixing cavity;

d. a bore for abrasive material passing from the outer cylindrical surface to the mixing cavity; and e. a rotational alignment slot in the cylindrical surface, parallel to the cylindrical surface, opposite the bore for abrasive material, extending from the upstream end of the cylindrical surface to the downstream end of the cylindrical surface.

3. The orifice body with a mixing cavity of claim 2 wherein the slot has a width approximately equal to the diameter of a pin designed to retain the orifice body against rotation.

4. The orifice body with a mixing cavity of claim 2 further comprising:

d. a tapered seat formed in the metal body at a downstream end of the mixing cavity, a portion of the tapered seat forming a conical section having metal of the metal body outside of the conical section and having void inside of the conical section.

* * * * *